United States Patent [19]

Broehl

[11] 4,077,348

[45] Mar. 7, 1978

[54] CHAIN STOPPER

[75] Inventor: Anton Broehl, Brohl-Lutzing, Germany

[73] Assignee: Lebus International, Inc., Longview, Tex.

[21] Appl. No.: 751,811

[22] Filed: Dec. 17, 1976

[51] Int. Cl.[2] ..... B63B 21/18

[52] U.S. Cl. ..... 114/200; 24/116 R

[58] Field of Search ..... 254/175.7; 59/78, 93; 24/116 R, 116 A; 114/199, 218, 200, 179–181, 210, 221 R, 230; 104/165 R, 172 RB, 172 C, 172 S, 173 R, 202, 227, 238, 239

[56] References Cited

U.S. PATENT DOCUMENTS

| | | | |
|---|---|---|---|
| 26,722 | 1/1860 | Tucker | 114/200 |
| 157,736 | 12/1874 | Coffin | 114/200 |
| 1,476,627 | 12/1923 | Luebke | 24/116 R |
| 3,289,626 | 12/1966 | Petrie | 114/200 |

*Primary Examiner*—Trygve M. Blix
*Assistant Examiner*—D. W. Keen
*Attorney, Agent, or Firm*—Richards, Harris & Medlock; Richards, Harris & Medlock

[57] ABSTRACT

A chain stopper for round bar iron chain, such as ship's anchor chain, includes spaced, parallel guideways for the horizontal links of the chain and incorporating therebetween a groove for guiding the vertical links of the chain, and having a pair of pawl section receiving recesses formed therein. At least one clamping lever is mounted for pivotal movement about a horizontal axis and includes a pair of pawl sections positioned to receive a vertical link therebetween and to engage a selected horizontal link, the pawl sections engaging the recesses of the guideways to securely lock the chain.

5 Claims, 4 Drawing Figures

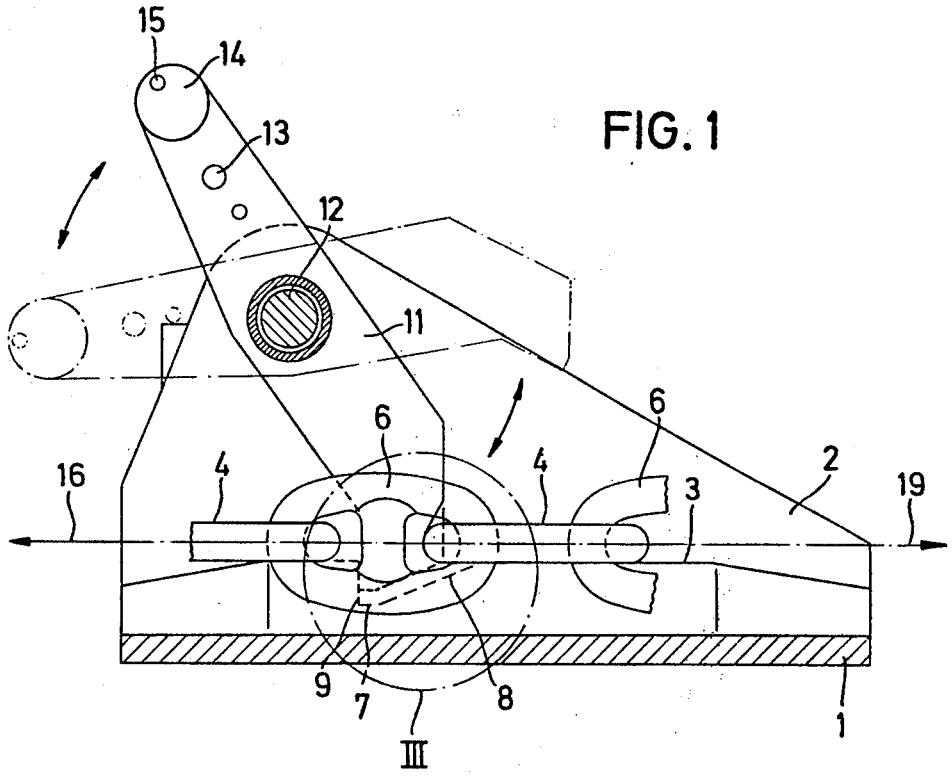
FIG. 1
FIG. 2
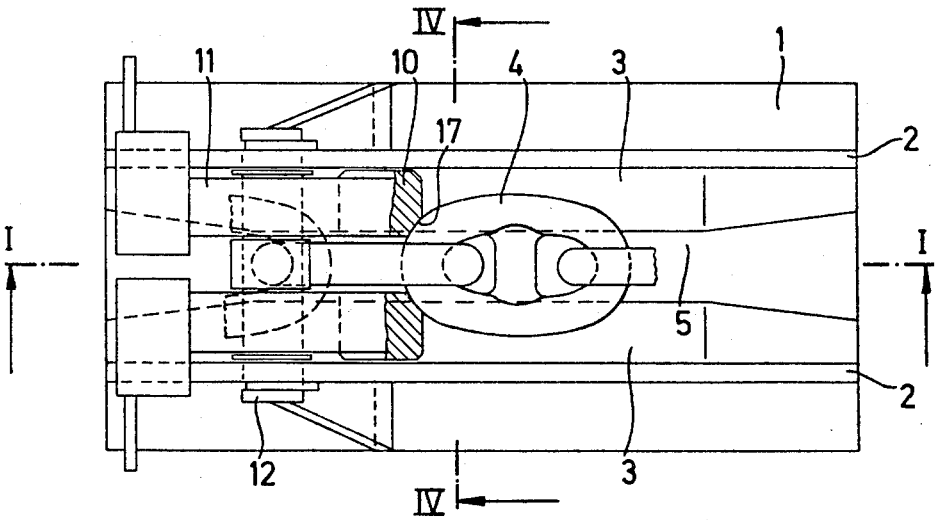

CHAIN STOPPER

BACKGROUND AND SUMMARY OF THE INVENTION

This invention relates to a chain stopper for a round bar iron chain, particularly a ship's anchor chain, including two guideways for the horizontally oriented links of the chain, these two guideways being arranged parallel with respect to the longitudinal direction of the chain and forming therebetween a groove for guiding the vertically oriented links of the chain, and further including at least one clamping lever which can be swung about a horizontal pin above the chain and which includes apparatus for locking the chain under tension.

So-called "chain stoppers" which are located between the hawse pipe and the capstan are used in order to secure ships lying at anchor and, at the same time, in order to relieve the capstan of the pull of the anchor chain with the anchor hanging thereon. These chain stoppers have to be arranged in such a way that they can absorb stresses up to the breaking load (or strain) of the anchor chain, without damage to the chain links being able to occur before the breaking load is reached.

In the case of the so-called "wedge stoppers" ("dog type") used up to now, the chain is led via a guideway and the vertically oriented chain link is locked by a steel rod with an approximately rectangular cross section, which lies at right angles to the upper open side of the guide. In so doing, the vertically oriented chain link is being held only unilaterally, i.e. only in single shear. As shown in practice, this single-shear locking of the chain link is not sufficient in order to absorb stresses up to the chain breaking load.

A chain stopper for a round bar iron chain is also known, in which two clamping jaws are provided, which are arranged symmetrically with respect to the longitudinal direction of the chain, are movable in the horizontal plane and serve in order to lock the chain under tension. These clamping jaws can be swung about vertical pins arranged on both sides of the chain guide. These clamping jaws, moreover, are designed in such a way that, seen in the direction of the anchor pull, they engage on the other side of the swivel pins of their lever arms and position themselves in a locking orientation in front of the chain link to be held. In order to actuate the clamping jaws, a threaded spindle is provided which engages longer swivel arms which are connected to the clamping jaw levers, so that the opening and the closing of the clamping jaws requires a longer length of time, depending on the actuation of the threaded spindle.

However, a chain stopper of this type is extremely bulky and, for this reason, cannot readily be installed subsequent to the original building and outfitting of a ship. Furthermore, the stresses occurring at the clamping jaws have to be absorbed by the threaded spindle via the clamping jaws and the swivel levers connected thereto.

The purpose of the present invention is to provide a chain stopper of the type mentioned hereinbefore in as space-saving a manner of construction as possible, in such a way that the stresses applied to the shaped parts of the clamping levers do not have to be absorbed by movable parts of the chain stopper, but will be intercepted by fixed abutment parts.

According to the invention, this object finds its solution in the fact that two pawl sections are arranged side by side in parallel and between each other allow a vertical slit to remain free for the passage of the vertical links of the chain, and in the fact that the pawl sections are of such a length that in the stopping position they engage, in a locking manner, in responses on the guideways for the horizontal links of the chain. In so doing, as seen in the direction of pull of the anchor, the shaped parts of the clamping levers encircle the horizontal link of the chain in such a form-locking manner that due to the resulting double shear connection, the horizontal link of the chain is in the position of absorbing stresses up to the chain breaking load, without damage to the chain or to the chain stopper. Such a chain stopper thereby guarantees not only a secure locking of the anchor chain, but also can be designed in such a compact manner that with its base plate it can be mounted subsequently on already existing fastening devices.

In a preferred form of embodiment of the invention it is provided that the pawl sections are arranged on two clamping levers which can be swung about a common horizontal pin in parallel to each other.

In order that the horizontal chain link held by the pawl sections finds a secure support on the shaped pieces, according to a further characteristic of the invention, it is provided for that the pawl sections have recesses adapted to the shape of the horizontal links of the chain and these recesses engage the rounded portions of the chain link concerned, on both sides of the subsequent vertically oriented link of the chain.

According to a further characteristic of the invention, each of the two recesses in the guideways is designed with a vertical abutment surface for the associated pawl section with this vertical abutment surface lying in the direction of pull of the anchor. The clamping levers are constructed as two-armed levers and carry counterweights at their extremity, so that the clamping levers can also be easily swung out of their locking position by hand.

DESCRIPTION OF THE DRAWINGS

Further details and advantages deriving from the invention will be apparent from the following description of a preferred example of embodiment schematically shown in the drawing, wherein:

FIG. 1 shows a vertical section through a chain stopper along line I—I in FIG. 2.

FIG. 2 is a topview of the chain stopper, with individual parts shown in section.

DETAILED DESCRIPTION

Figure 3:
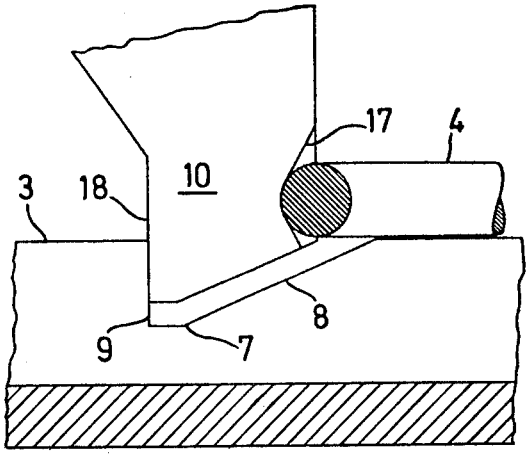
FIG. 3 is an enlarged representation of details of the chain stopper, which are enclosed by a dot-dash circle in FIG. 1.
Figure 4:
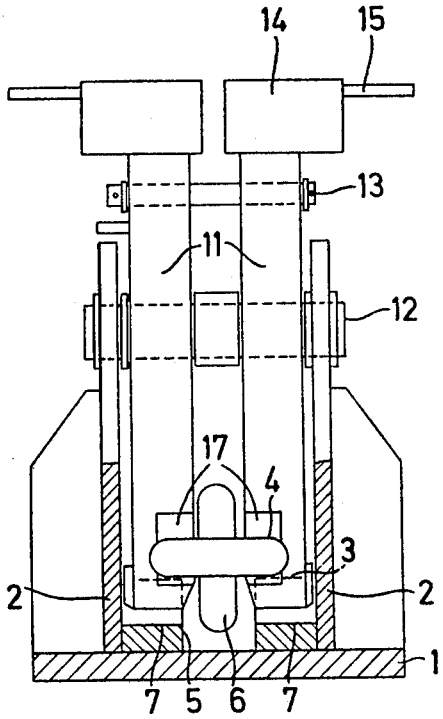
FIG. 4 shows a vertical section through the chain stopper along line IV—IV in FIG. 2.

The chain stopper shown in the drawing consists of a base plate 1 and two vertical side plates 2 at parallel distances from each other. Between the side plates 2, two guideways 3 are arranged for the horizontally oriented links 4 of a chain to be stopped. The two horizontal guideways 3 allow a groove 5 located between each other to remain free in order to guide the vertically oriented links 6 of the chain. The horizontal guideways 3 slope off towards their extremities in an approximately wedge-shaped manner. In each of the two horizontal guideways 3 a recess 7 is designed which has a base surface area 8 which slopes off in the direction of pull of the anchor chain in approximately wedge-shaped manner and is inclined towards a vertical abutment surface 9 for the shaped parts or pawl sections 10 of two clamping levers 11. The clamping levers 11 are pivoted in swiveling fashion on a pin 12 between the two side plates 2 of the chain stopper. The vertical abutment surfaces 9 of the two recesses 7 are located in a common vertical plane which lies in front of the longitudinal axis of pivot pin 12, as seen in the direction of pull of the anchor chain.

Both clamping levers 11 are constructed as two-armed levers and loosely connected to one another by means of a bolt 13. At their extremity, they possess correspondingly selected counterweights 14 with handles 15, in order to make it possible to swing the clamping levers in and out by manual force.

At its lower end, each clamping lever 11 has an extension, which is bent at an angle of about 30 degrees to 40 degrees with respect to the longitudinal axis of the lever, in the direction of pull of the anchor chain (arrow 16 in FIG. 1), and with which it engages the recess 7 on the horizontal guideway 3 of the chain stopper. This lower bent extension is designed as a pawl section 10, having a recess 17 which is adapted to the shape of the horizontal links 4 of the chain and a vertical stop face 18 with which, in the stopping position, it rests against the vertical abutment surface 9 of the recess 7. In addition, these pawl sections 10 are arranged at such a mutual distance from each other that they allow a vertical slit to remain free between each other for the passage of vertical links 6 of the chain.

The chain stopper operates as follows. After unlocking, the two two-armed clamping levers 11 are pivoted on pin 12 and swung out of their position of rest indicated in FIG. 1 by dot-dash lines, in such a way that their pawl sections 10 come to lie on the chain. On further relaxing of the chain in the direction of arrow 16, the shaped parts 10 lap over the next following vertical link 6 of the chain and fall into the two lateral clearances between two successive horizontal links 4 of the chain. They are thereby introduced into the two recesses 7 on the guideways 3. The rounded part (which is located in front in the direction of pull) of the next following horizontal link 4 of the chain engages the correspondingly adapted lateral recesses 17 on the pawl section 10 and swings the two clamping levers 11 until stop face 18 of the clamping levers 11 come to rest against the vertical abutment surface 9 of the associated recess 7. Thus a superior locking of the anchor chain has occurred. By means of the adaption of recesses 17 of paw sections 10 to the rounded part of the chain link to be held, an efficient, double shear, highly stressed connection is guaranteed, which is suitable for the transmission of stresses up to the chain breaking load.

In order to open the chain stopper, the chain is moved in the opposite direction (arrow 19 in FIG. 1), so that the clamping levers 11 with their shaped parts 10 are lifted out of the locking position and, on continued movement of the chain, slide along the moving chain links. Clamping levers 11 can be brought into the horizontal position by manual force and secured.

What is claimed is:

1. A chain stopper for a round bar iron chain, particularly a ship's anchor chain, including:

two guideways for the horizontally oriented links of the chain, said two guideways including preformed detents thereon and being arranged parallel with respect to the longitudinal direction of the chain and incorporating therebetween a groove for guiding the vertically oriented links of the chain, and at least one clamping lever mounted for pivotal movement about a horizontal pin above the chain and including pawl sections for locking the chain under pull, characterized by the fact that:

the two pawl sections are arranged side by side in parallel and between each other provide a vertical slit to remain free for the passage of the vertical links of the chain, and the pawl sections are of such a length that in the locking position they engage, in a locking manner, in the detents on the guideways for the horizontal links of the chain.

2. The chain stopper according to claim 1, further characterized by the fact that the pawl sections are arranged on two clamping levers which can be swung about a common horizontal pin in parallel to each other.

3. The chain stopper according to claim 1, further characterized by the fact that pawl sections exhibit recesses adapted to the shape of the horizontal links of the chain and said recesses engage the rounded part of the concerned link of the chain, on both sides of the subsequent vertically oriented link of the chain.

4. A chain stopper for a round bar iron chain, particularly a ship's anchor chain, including:

two guideways for the horizontally oriented links of the chain, said two guideways being arranged parallel with respect to the longitudinal direction of the chain and incorporating therebetween a groove for guiding the vertically oriented links of the chain, and at least one clamping lever mounted for pivotal movement about a horizontal pin above the chain and including pawl sections for locking the chain under pull, characterized by the fact that:

the two pawl sections are arranged side by side in parallel and between each other provide a vertical slit to remain free for the passage of the vertical links of the chain, the pawl sections are of such a length that in the locking position they engage, in a locking manner, in recesses on the guideways for the horizontal links of the chain, and each of the two recesses in the guideways is provided with a vertical abutment surface for the associated pawl section with this vertical abutment surface lying in the direction of pull of the anchor.

5. A chain stopper for a round bar iron chain, particularly a ship's anchor chain, including:

two guideways for the horizontally oriented links of the chain, said two guideways being arranged parallel with respect to the longitudinal direction of the chain and incorporating therebetween a groove for guiding the vertically oriented links of the chain, and at least one clamping lever mounted for pivotal movement about a horizontal pin above the chain and including pawl sections for locking the chain under pull, characterized by the fact that:

the two pawl sections are arranged side by side in parallel and between each other provide a vertical slit to remain free for the passage of the vertical links of the chain, the pawl sections are of such a length that in the locking position they engage, in a locking manner, in recesses on the guideways for the horizontal links of the chain, and the clamping levers are constructed as two-armed levers and carry counterweights at their extremities.

* * * * *